US007493747B2

(12) United States Patent
Bader

(10) Patent No.: US 7,493,747 B2
(45) Date of Patent: Feb. 24, 2009

(54) COMPOSITE TWIST CORE-SPUN YARN AND METHOD AND DEVICE FOR ITS PRODUCTION

(75) Inventor: Yves Bader, Thoiry (FR)

(73) Assignee: E. I. du Pont de Nemours and Company, Wilmington, DE (US)

( * ) Notice: Subject to any disclaimer, the term of this patent is extended or adjusted under 35 U.S.C. 154(b) by 122 days.

(21) Appl. No.: 11/598,456

(22) Filed: Nov. 13, 2006

(65) Prior Publication Data

US 2007/0062172 A1 Mar. 22, 2007

Related U.S. Application Data

(62) Division of application No. 10/663,546, filed on Sep. 15, 2003, now Pat. No. 7,155,891.

(51) Int. Cl.
*D02G 3/36* (2006.01)

(52) U.S. Cl. ..... 57/3; 57/5

(58) Field of Classification Search ..... 57/3, 57/11, 12, 13, 18
See application file for complete search history.

(56) References Cited

U.S. PATENT DOCUMENTS 4,100,727 A * 7/1978 Hamel ..... 57/12
4,541,231 A 9/1985 Kullman et al.
4,922,701 A * 5/1990 Sawhney et al. ..... 57/12
4,958,485 A * 9/1990 Montgomery et al. ..... 57/210
4,976,096 A * 12/1990 Sawhney et al. ..... 57/12
5,802,826 A 9/1998 Folk et al.
6,318,060 B1 * 11/2001 Dinkelmann et al. ..... 57/3
6,405,519 B1 * 6/2002 Shaikh et al. ..... 57/210
2003/0131577 A1 * 7/2003 Chiu et al. ..... 57/12

FOREIGN PATENT DOCUMENTS

| | | | |
|---|---|---|---|
| CN | 1 330 175 | A | 1/2002 |
| EP | 0 271 418 | A1 | 6/1988 |
| FR | 2 549 862 | A | 2/1985 |
| GB | 765 295 | A | 1/1957 |

* cited by examiner

*Primary Examiner*—Shaun R Hurley

(57) ABSTRACT

A substantially torqueless composite dual core-spun yarn (10) is produced by introducing two slivers (30A,30B) forming a covering (30) together with a central (20) core in a spinning triangle (40). The core (20) is fed overtwisted S or Z and the slivers (30A,30B) have an opposite Z or S twist corresponding to about 30% to 70% of the twist of the fed overtwisted core (20) that detwists during spinning. The inelastic core (20) is fed at controlled speed to compensate for the angle of feed and to compensate for detwisting, and is guided into the spinning triangle (40) by a guide groove (52) in a feed roller (50).

13 Claims, 8 Drawing Sheets

COMPOSITE TWIST CORE-SPUN YARN AND METHOD AND DEVICE FOR ITS PRODUCTION

CROSS REFERENCE TO RELATED APPLICATIONS

The present application is a divisional application of U.S. patent application Ser. No. 10/663,546, filed Sep. 15, 2003, now U.S. Pat. No. 7,155,891, the contents of which are incorporated herein by reference.

BACKGROUND OF THE INVENTION

1. Field of the Invention

This invention relates to a composite twist-spun yarn of the type having a central "hard" core covered with a dual-spun fiber covering, as well as to fabrics woven or knitted from the composite dual core-spun yarn, and to a method and a device for production of the yarn.

2. Description of Related Art

The invention is particularly concerned with improvements in twist-spun yarns that are substantially inextensible, i.e. where the central hard core has an elongation at break less than 50%. Elongation at break of a yarn specimen is the increase in length produced by the breaking force, expressed as a percentage of the original nominal length. All values of elongation at break in the present disclosure are those established according to the methodology based ISO 2062, according to which a specimen of yarn is extended until rupture by a suitable mechanical device and elongation at break are recorded. A constant rate of specimen extension of 100% per minute (based on the specimen length) is used. Although ISO 2062 makes reservations about its applicability to certain yarns, its method is adequate for determining if any yarn has an elongation at break below or above 50%.

Twist spun yarns with a central core covered with a dual-spun fiber covering are produced by bringing together two fiber slivers to form a spinning triangle, feeding the core in the spinning triangle between the two fiber slivers with the latter at an angle to the core, and spinning the brought-together fiber slivers around the core with an S or Z twist that is the same as or opposite to that of the core.

This so-called Siro-core-spun process—which has the advantage of being a "one-step" spinning process—has been successful in particular for producing stretchable yarns that are widely used for manufacturing stretch fabrics. These stretch yarns have elastane cores made for example of the polyurethane-elastane available from E. I. du Pont de Nemours and Company, Wilmington, Del., U.S.A., under the trademark LYCRA®.

Elastane cores typically have an elongation at break of 400% or more. During the spinning process the elastane core is drafted between 250% and 350%, such that the elasticity of the core "takes up" the fiber covering, leading to the production of composite elastic yarns with consistent stretch and coverage by the fiber covering. However, when the Siro-core-spun process is applied to substantially inelastic cores (elongation at break less than 50%, usually well below 50%, and rarely exceeding 40%), problems arise. During the spinning process, it is difficult to guide the inextensible core to the convergence point of the spinning triangle, and the core is liable to jump and break. In the resulting composite twist spun yarns, the core tends to emerge to the surface at points along the yarn, leading to a "low" coverage of the core. The maximum achievable coverage of the inextensible core is about 70%. Methods of estimating the core coverage are described below. When the core and covering are of contrasting colors, this leads to a speckled appearance in fabrics woven or knitted from the yarn, known as "Chine", which is not always wanted. For these reasons, the Siro-core-spun process has not been used for inelastic hard cores to a great extent and, when it is, special precautions need to be taken and there are serious limitations in the produced yarn.

A different process for spinning twist-spun yarns with a substantially inextensible central core has been proposed in European Patent 0 271 418. This discloses a process for producing a composite yarn by feeding the core, in particular an aramid core, with the core's torsion coefficient appreciably less than its critical torsion coefficient, and twisting the covering fibers on the core during the spinning operation such that the total torsion coefficient of the yarn is less than its critical torsion coefficient. More precisely, the torsion coefficient of the core (discussed further below) is equal to the value of the critical torsion coefficient of the yarn less the value of the total torsion coefficient of the composite yarn multiplied by the proportion of the core yarn in the composite yarn. The process of EP 0 271 418 has the disadvantage that the produced core yarn necessarily has a resulting torque. To obtain a substantially torqueless final yarn, two of the covered yarns must be assembled by twisting them together in opposite directions, as will be explained below in connection with FIG. 3. This implies a two step spinning process, which is less attractive.

SUMMARY OF THE INVENTION

The invention provides a composite twist-spun yarn with substantially no torque (referred to herein as "substantially torqueless") and having a central hard core covered with a dual-spun fiber covering, wherein the central hard core has an elongation at break less than or equal to 50% and has a Z or S twist, and the fiber covering comprises dual-spun fibers twisted on the core with an S or Z twist opposite to that of the core, the opposite twists of the core and of the covering exerting opposite and substantially equal torques.

The composite yarn according to the invention is substantially torqueless by "cancellation" of the substantially equal and opposite torques of the core and the cover, as will be further discussed below with reference to FIGS. 1 and 2.

Another main aspect of the invention is a process for producing a substantially torqueless composite twist-spun yarn having a central hard core covered with a dual-spun fiber covering, wherein the central hard core has an elongation at break less than 50%. The process according to the invention comprises the following steps: bringing together two fiber slivers to form a spinning triangle; feeding the substantially inextensible central hard core in the spinning triangle between the two fiber slivers with the latter at an angle to the central core, the fed core being guided in the spinning triangle and having a Z or S twist that is overtwisted relative to the twist of the finished composite yarn; controlling the speed of feeding the core in the spinning triangle to compensate for the angle between the slivers and the core and for detwisting elongation of the core; and spinning the brought-together fiber slivers around the core with an S or Z twist opposite to that of the core and corresponding to about 30% to about 70% of the twist of the fed overtwisted core to obtain said substantially torqueless composite core-spun yarn.

A further main aspect of the invention is a device for producing a substantially torqueless composite twist-spun yarn having a central hard core covered with a dual-spun fiber covering, wherein the central hard core has an elongation at break less than 50%, the core has an Z or S winding and the fiber covering has an S or Z winding opposite to that of the core. The device according to the invention comprises: means for bringing together two fiber slivers in a spinning triangle; means for feeding the substantially-inextensible central hard core in the spinning triangle between the two fiber slivers whereby the core is guided in the spinning triangle with the two fiber slivers at an angle to the central core, the core having a Z or S winding that is overtwisted relative to the twist of the finished composite yarn; means for controlling the speed of feeding the core in the spinning triangle to compensate for the angle between the slivers and the core and for detwisting elongation of the core; and means for spinning the brought-together fiber slivers around the core with an S or Z winding opposite to that of the core and corresponding to about 30% to about 70% of the twist of the fed overtwisted central hard core to obtain said substantially torqueless composite core-spun yarn.

The invention also covers a fabric woven or knitted from the essentially torqueless composite twist-spun yarn having a substantially inextensible hard core and a dual-spun fiber covering as set out above and in the following.

BRIEF DESCRIPTION OF THE DRAWINGS

In the accompanying drawings given by way of example.

DETAILED DESCRIPTION OF THE INVENTION

Figure 1:
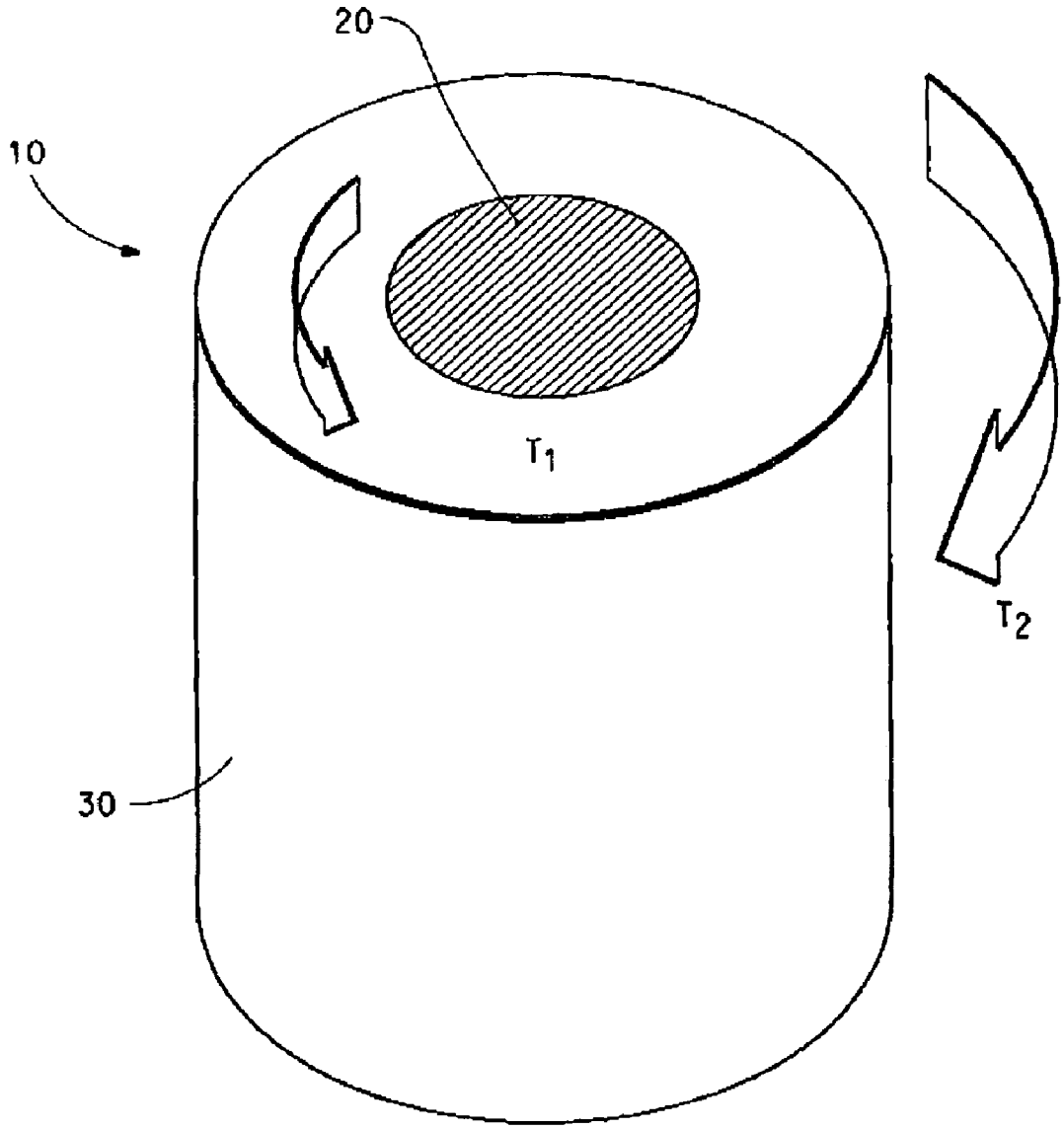
FIG. 1 is a schematic representation of a substantially torqueless composite twist-spun yarn according to the invention.

The Substantially Inextensible and Torqueless Composite Twist-Spun Yarn

According to the invention, a substantially inextensible and torqueless composite yarn 10 is twist spun with an essentially inextensible central hard core 20 having a covering 30.

The core 20 has an elongation at break less than 50%. Cores/yarns that are substantially inelastic typically have elongation at break well below 50%, usually below 40%. On the other hand, if a core/yarn is extensible its elongation at break is usually well above 50%, typically several hundred %. It is therefore easy to distinguish between substantially inelastic cores and elastic cores, using the value of elongation at break "less than 50%" as an easy-to-manage value for the purpose of differentiation.

The core 20 is conveniently chosen from monofilaments, multiple filaments, spun yarns and composites thereof. The core 20 can be made of materials chosen from glass, metal, synthetic fibers and filaments, carbon multifilaments and fibers, artificial fibers, natural fibers, antistatic fibers and composites thereof, according to the desired characteristics and the intended application of the final twist-spun composite yarn 10.

For many applications, a core 20 made of aramid fibers is advantageous. Commercially available meta-aramid fibers (for example those available under the trademark NOMEX® from E. I. du Pont de Nemours and Company, Wilmington, Del., U.S.A.) have an elongation at break in the range 20-30%. Commercially available para-aramid fibers (for example those available under the trademark KEVLAR® from E. I. du Pont de Nemours and Company, Wilmington, Del., U.S.A.) have an elongation at break in the range 0-5%. Other core materials can be used, depending on the application. A core made of glass fibers typically has an elongation at break from 0-5%, whereas those made of polyester and cotton typically have an elongation at break from 5-30%.

The covering 30 can be made of synthetic, artificial or natural fibers chosen according to the desired yarn characteristics and function. The fiber covering 30 can be a functional covering providing at least one of: high visibility (e.g., tinted viscose), low friction (e.g., PTFE), reinforcement (e.g., para-aramids), light-fastness (e.g., pigmented fibres), aesthetic appearance (e.g., meta-aramids or viscose), UV-protection (e.g., UV protective fibres), protection of the core (e.g., polyester, polyamide, viscose, PVA, or polyvinyl alcohol), abrasion resistance (e.g., meta- or para-aramids), protection against heat and thermal performance (e.g., meta-aramids, PBI, polybutylimide, PBO, polybenzoxazole, POD, or poly-p phenyline oxadiazole), fire-resistance (e.g., meta-aramids, PBI, or PBO), cut resistance (e.g., para-aramids or HPPE, high-performance polyethylene), protection against molten metal adhesion (e.g., blends of wool and viscose), adhesion (e.g., wool), anti-static effect (e.g., steel, carbon, or polyamide fibres), anti-bacterial effect (e.g., copper, silver, or chitosan), and comfort (e.g., wool, cotton, viscose, meta-aramids, or modified polyester available from E. I. du Pont de Nemours and Company, Wilmington, Del., U.S.A. under the trademark Coolmax®). The quoted covering fibers are mentioned simply as examples; many different types of fibers can be employed for the covering.

For some applications, in particular for high visibility and aesthetics, the covering 30 can conveniently be made of viscose fibers.

Using the process and device described in detail below, the central hard core 20 of the substantially inextensible and substantially torqueless yarn 10 can be covered to any suitable degree as required by the intended application. The % covering of the core 20 can be estimated by visual inspection of the composite fibers, especially when the cores and coverings are of contrasting colors. This estimation can be made directly or using photographs or video images, as in the Examples below. Typically at least 70% of the core 20 is covered by the fiber covering 30, but one of the particular advantages of the invention is that it is possible to achieve a covering of at least 90%, and even 95-100%, which was much more difficult or even impossible to achieve by prior art twist-spinning methods for substantially inextensible core-spun composite fibers.

The core 20 typically constitutes 10-30 wt % of the total weight of the composite yarn 10. The core 20 can have any linear mass suitable for the core spinning process. Its linear mass is typically from 5-20 tex (tex=1000× mass (g)/length (m)). The core mass is defined by the linear density of the core 20 (mass per unit length) measured by the skein method as described by the norm ISO 2060. The covering fiber mass is defined as the difference of the final yarn linear density reduced by the core linear density. The linear mass of the composite yarn is typically from 20-120 tex, and that of the covering is typically from 15-100 tex.

Yarn Torque

As schematically illustrated in FIG. 1, the composite yarn 10 according to the invention is substantially torqueless by "cancellation" of the substantially equal and opposite torques $T_1$ of the core 20 and $T_2$ of the cover 30, as indicated by the arrows. The composite yarn of the invention, being substantially torqueless, has no tendency to twist. Moreover, when two substantially torqueless yarns 10 (or yarn sections) come to touch, they have no tendency to wrinkle.

The presence or absence of torque in a yarn can be checked by a simple test, as follows. A length of yarn is held approximately horizontally with outstretched arms, i.e., with the horizontal yarn occupying 100% of its length. Then the two hands are slowly brought together, allowing the yarn to droop. As the hands come together, if the yarn has an inherent torque, the yarn winds into a spiral as it comes together. When the hands meet, the wound yarn is tangled and it is difficult to pull it apart again. On the other hand, if the yarn has no or substantially no torque, as the hands come together the yarn remains untangled or at most has only a few winds, so that when the hands meet they can easily be moved apart to bring the yarn back to its initial horizontal position.

The coefficient of torsion is a factor a giving the relation of the twist level of a yarn with the square root of its linear density expressed in "Cotton metric count" (also called "Number Metric" Nm). The Cotton metric count is defined by the length in meter of a gramme of yarn.twist (turns per meter)=$\alpha\sqrt{Nm}$ Torque is also defined as the resultant force in a yarn by which the yarn tends to de-twist itself or, as another consequence, for yarns to "wrinkle" amongst themselves.

Figure 2A:
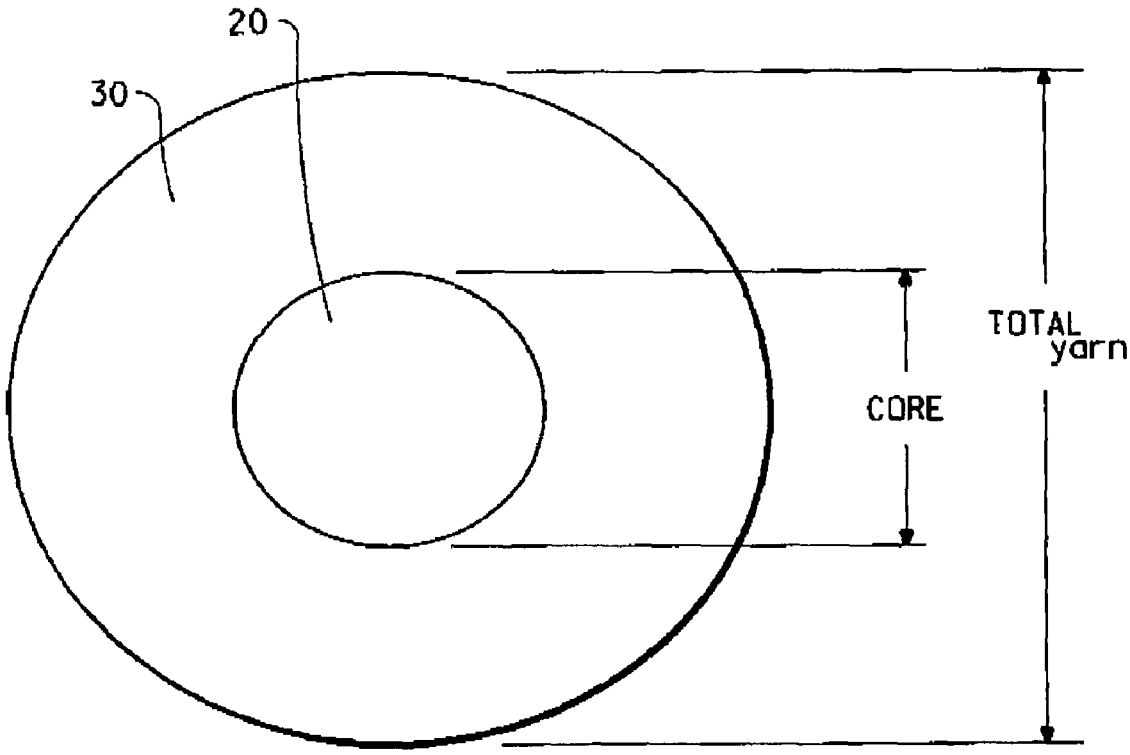
FIGS. 2A and 2B are diagrams illustrating the calculation of the moment of inertia for a twist-spun yarn according to the invention.
Figure 2B:
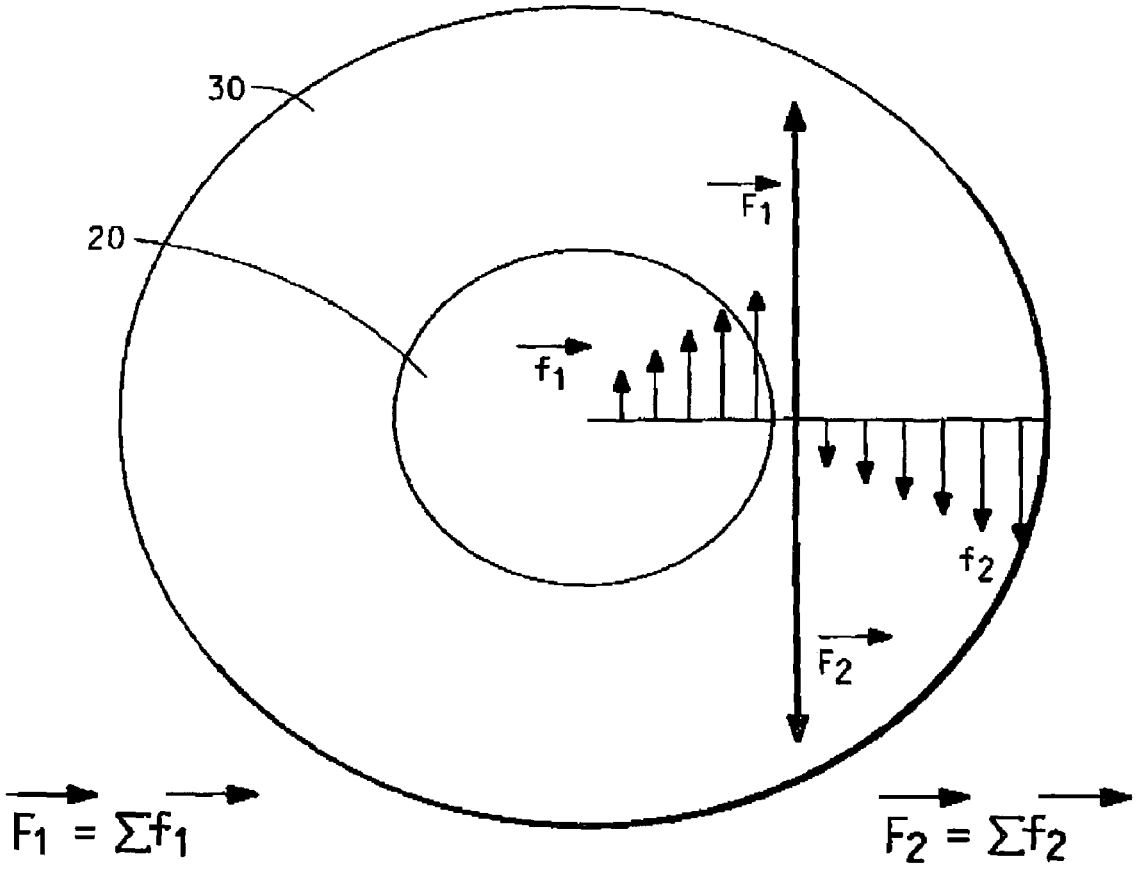

FIG. 2 diagrammatically illustrates a composite torqueless yarn according to the invention whose core 20 has a diameter $d_{core}$ and whose covering 30 has a diameter $d_{total}$. The moment of inertia J of the core spun yarn 10 can be defined as:

$$J_{core}=\pi/32 d^4_{core} \text{ and } J_{covering}=\pi/32\,(d^4_{total}-d^4_{core}).$$

In the case where the yarn is composed of different fibres in the core and in the covering, a correction factor $G_{(Modulus\ of\ inertia\ of\ the\ material)}$ has to be introduced in order to compensate for the different torque behaviors.

Finally, the previously-described torque is created by the applied moment of torsion T:

$$T_{(applied\ moment\ of\ torsion)}=G_{(Modulus\ of\ inertia\ of\ the\ material)}\times J_{(Moment\ of\ Inertia)}\times\phi_{(turns\ per\ meter)}$$

Where $\phi$ is the twist in turns per meters (tpm) applied to the fibers in the yarn.

Our objective is to equalize the applied moment of torsion of the core 20 with the applied moment of torsion of the covering 30. This is achieved by $$\phi_{remaining\ in\ core}/\phi_{final\ yarn}=G_{covering\ material}/G_{core\ material}\times J_{covering}/J_{core}.$$

This is schematically represented in FIG. 2 which shows that the force F1 acting on the periphery of the core 20, and which is the sum $\Sigma f_1$ of the torque forces $f_1$ acting in the core 20, is equal and opposite to the force $F_2$ applied on the periphery of the core 20 by the covering 30, and which is the sum $\Sigma f_2$ of the torque forces $f_2$ acting in the covering 30.

During production of the composite yarn 10 according to the invention, the core 20 is initially overtwisted and untwists during the spinning to produce the torqueless composite yarn 10. This untwisting leads to an elongation of the core 20 and because of this the speed of feeding the core 20 needs to be adjusted to compensate for this untwisting, by a compensating factor k. This factor k for compensating the detwisting elongation of the core 20 is measured empirically for each core having regard to its dimensions and physical properties, either by testing on the spinning machine used in the process, or using a laboratory twist measurement machine.

The core 20 preferably has an initial twist coefficient $\alpha$ in the range 70-120 turns$\times g^{1/2}\times m^{-3/2}$, where $\alpha$=twist/(1000/tex)$^{-1/2}$ and tex=1000×mass(g)/length(m).

The twist coefficient in the composite core can be the same as the twist coefficient of the cover. However, the twist in turns per meter will be different.

If we take for example a twist coefficient value of 80 for the initial core 20 which has an Nm value of 100, we have, twist=$\alpha\sqrt{Nm}$ twist=$80(100)^{1/2}$=800 tpm.

The covering 30 of the final yarn 10 also has a twist coefficient value of 80, but an Nm value of 25, so we have twist=$80(25)^{1/2}$=400 tpm.

The resulting twist in the spun core 20 is thus 800Z−400S=400Z.

Prior Art Comparison

Figure 3:
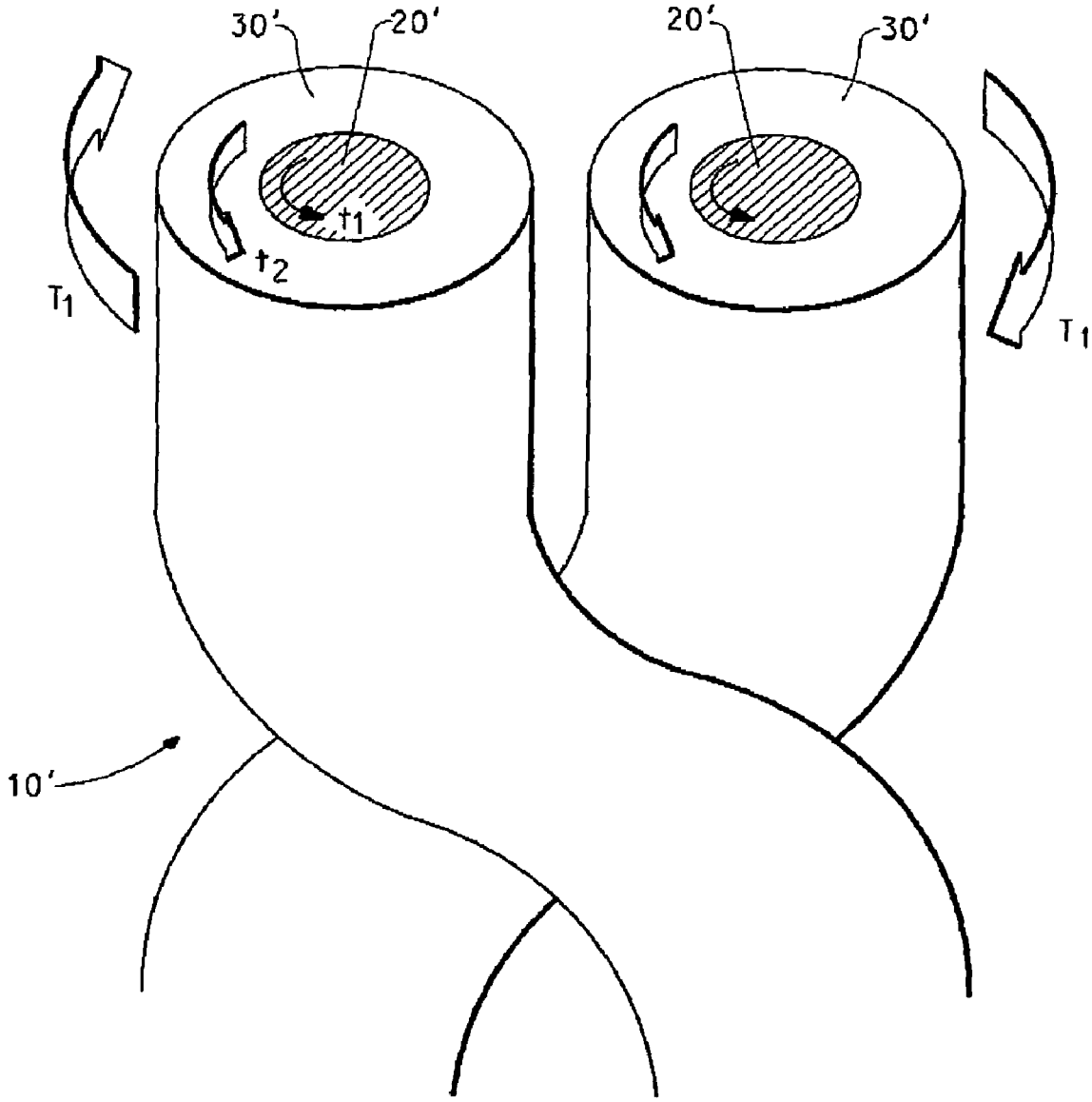
FIG. 3 (Prior Art)
FIG. 3 is a schematic representation of a dual yarn made by assembling two yarns produced by the method of EP 0271 418.

For comparison, FIG. 3 schematically shows a composite twist-spun yarn 10' produced by the process of European Patent 0 271 418. The yarn 10' produced by this process comprises a core 20', in particular an aramid core, with a covering 30'. Each yarn is spun with the torsion coefficient of core 20' appreciably less than its critical torsion coefficient. The covering fibers 30' are spun on the core 20' such that the total torsion coefficient of the yarn 10' is less than its critical torsion coefficient. This leads to a twist-spun yarn having a core 20' with a twist $t_1$ surrounded by a covering 30' twisted in the same direction with a twist $t_2$. Because each individual yarn 10' is twisted, to produce a composite yarn with neutral torque two of the covered yarns 10' must be assembled after spinning by twisting them together in opposite directions with an applied twist $T_1$ opposite to $t_1$,$t_2$, as illustrated in FIG. 3. This produces an overall dual yarn which is torqueless, but this implies a two-step spinning process.

In contrast, according to the invention, a composite core-spun yarn with neutral torque is obtained in a one-step spinning process.

The Twist Spinning Process and Device of the Invention

Figure 4A:
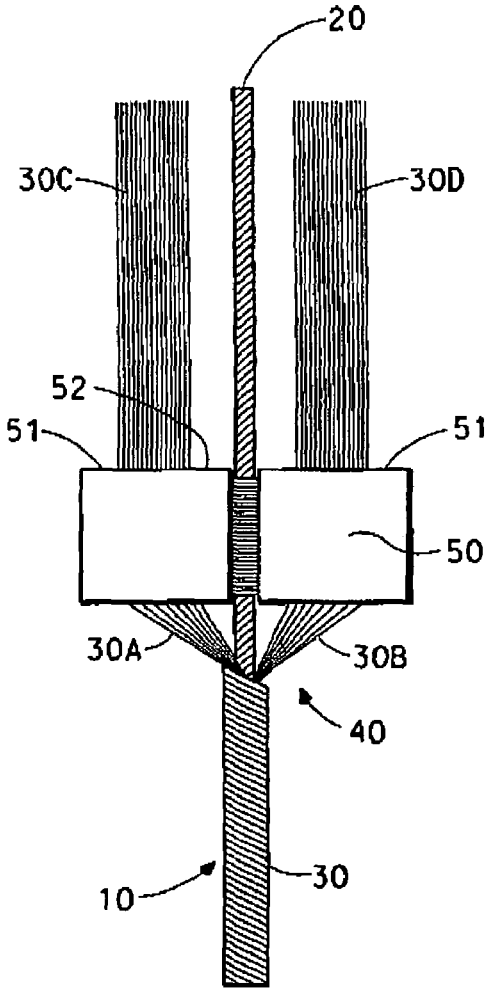
FIG. 4A is a schematic representation of a spinning device according to the invention.
Figure 4B:
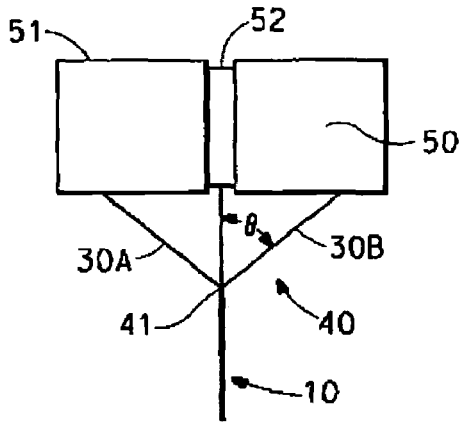
FIG. 4B is a diagram of the spinning triangle of the device shown in FIG. 4A.

In the production process of the above-described substantially inextensible and substantially torqueless twist-spun composite yarn 10, two slivers 30A and 30B making up the fiber feed for the covering 30 are fed in a spinning triangle 40 inclined at an angle θ to the central hard core 20, as illustrated in FIGS. 4A and 4B. The slivers 30A,30B are fed to the spinning triangle 40 at a speed V, and the core 20 is fed to the spinning triangle 40 at a speed close to k.V.cos θ, where k is the above-mentioned factor compensating for the detwisting elongation of the core 20.

This speed control, combined with the below-described accurate guiding of the core 20, ensures that the slivers 30A, 30B and the core 20 meet at the convergence point 41 of the spinning triangle 40 under optimal spinning conditions avoiding problems related in particular with the inextensibility of the core 20 and its overtwisting.

As illustrated, the two inclined slivers 30A,30B are obtained typically by feeding from two parallel rovings 30C, 30D, which can be achieved using known equipment that is adapted so the substantially inextensible and over-twisted hard core 20 is guided and driven into the spinning triangle 40 at a controlled speed, as explained above. This controlled speed of core 20 is set by a positive drive on the core 20 or by braking an overfed core 20. Positive drive can be provided by inserting a gear mechanism in the kinematic chain of the spinning frame, or by using an individual motor with a special control. Braking of the core 20 can be achieved by means of a braking roller, or other convenient means.

Figure 5:
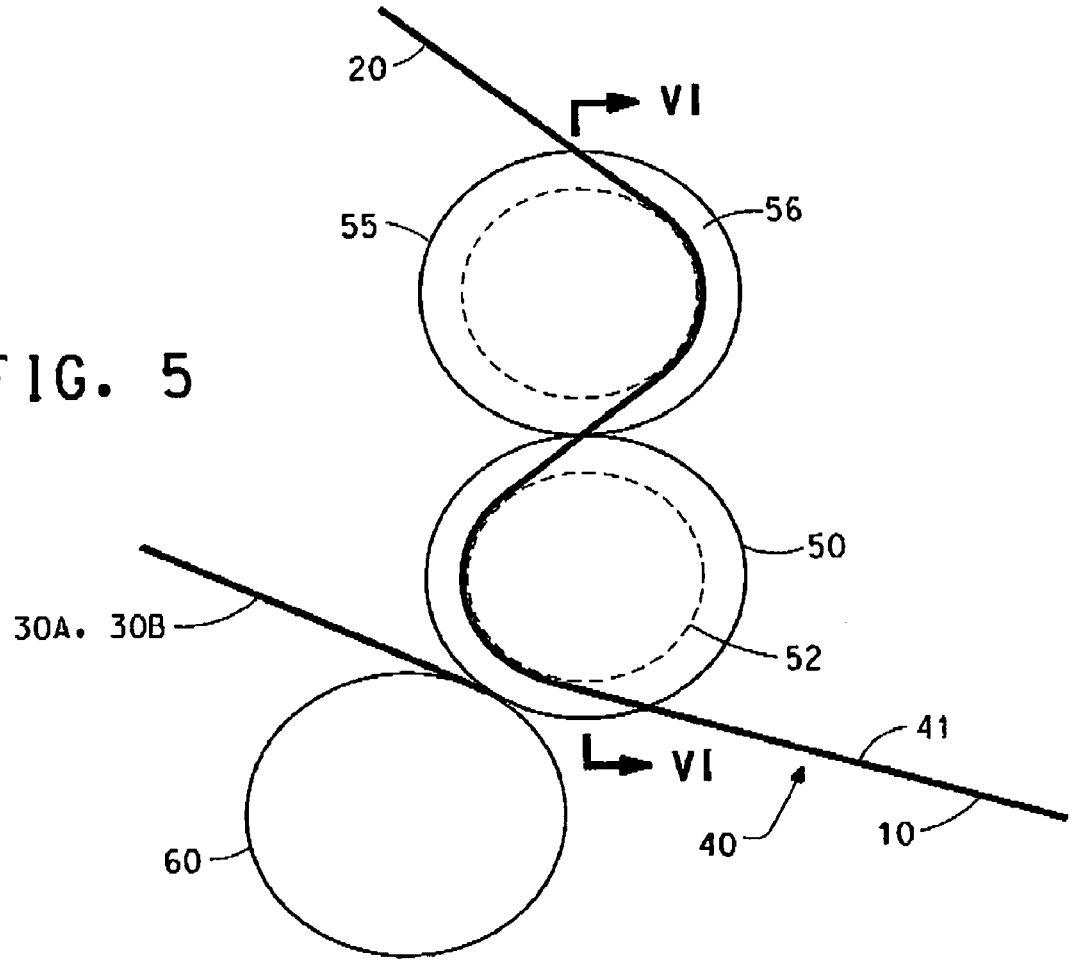
FIG. 5 is a diagram showing an arrangement of rollers for feeding the core and the slivers to the spinning triangle.
Figure 6:
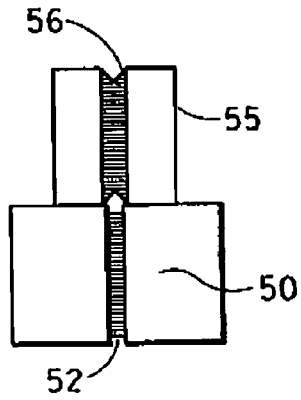
FIG. 6 is a diagrammatic cross-section along line VI-VI of FIG. 5 illustrating the means for guiding the core, the latter not being shown.

The two fiber slivers 30C,30D are brought together in the spinning triangle 40 by passing over a feed roller 50 having lateral smooth guide surfaces 51 for the slivers 30C,30D, this feed roller 50 cooperating with a facing roller 60, see FIG. 5. The core 20 is guided in the spinning triangle 40 by passing through a guide groove 52 centrally located on the feed roller 50. To ensure accurate guiding of the core 20 into groove 52, the core is fed over a centering roller 55 cooperating with the feed roller 50. As shown in FIG. 6, the centering roller 55 has a central V-shaped pre-guide groove 56.

Guide groove 52 is advantageously of substantially U-shaped cross section, the width and depth of groove 52 being sufficient to receive the hard core 20. However, a groove 52 of another shape can be used provided it guides well the hard core 20 and prevents it from jumping over the cylindrical surface 51 of the feed roller 50. The width of groove 52 is chosen as function of the size of the feed roller 50, and is sufficiently small to avoid that the "freely slipping" slivers 30A,30B risk moving over the smooth surface of feed roller 50 and entering the groove 52. On the other hand the groove 52 must be sufficiently large that it can receive the core 20 and allow movement of the core 20 in the groove 52 independent from movement of the roller 50. A preferred shape for groove 52 is a U-shape with flat facing sides and chamfered edges. Typically the groove 52 is 1-3 mm wide and 1-20 mm deep. The depth of the groove is limited by the need to reduce rubbing of the core 20 against the sides of groove 52, so in principle the wider the groove 52 the deeper it can be.

The V-shaped pre-guide groove 56 in the centering roller 55 can be wider than the groove 52. The dimensions of pre-guide groove 56 are not critical: what counts is that the apex of pre-guide groove 56 is centered exactly over the center of guide groove 52, so as to feed the core 20 accurately and centrally into the middle of groove 52, avoiding contact of the core 20 with the groove 52's edges. The pre-guide groove 56 can be similar to the known V-shaped grooves used to feed an elastomeric core onto a non-grooved feed cylinder in the conventional Siro-core-spun process. In the new process, the V-shaped groove 56 is used for a new purpose, to ensure perfect positioning of the core 20 in the central guide groove 52.

The fed core 20 tends to jump as a result of tensions created due to the low elasticity of the core 20 and varying forces acting at the point of convergence 41. By passing the core 20 accurately and centrally into the central groove 52 as described, it is firmly and evenly held and guided with very little play to the point of convergence 41. This results on the one hand in less breakage of the core 20 and/or slivers 30A, 30B, and on the other hand a more even and complete coverage of the core 20 by its covering 30 in the resulting composite yarn 10.

The fed core 20 is initially twisted in the S or Z direction with a twist that is overtwisted relative to the twist of the finished composite yarn direction. During the spinning operation, the brought-together slivers 30A,30B are spun around the core 20 with a twist opposite to that of the core 20 and corresponding to about 30% to 70% of the twist of the overfed core 20. During spinning, the core 20 will be obliged to twist in the opposite direction of its original twist. This process is called detwisting. During the detwisting, the core 20 will naturally elongate as the orientation of the individual fibres are closer to parallel to the yarn axis. For this reason, the speed of feeding of the core 20 is adjusted to compensate for this elongation, as described above.

As a result of detwisting of the core 20 during spinning, and by selection of the degree of opposite twist of the slivers 30A,30B as a finction of the relative masses and dimensions of the core 20 and covering 30, the resulting composite fiber 10 has a neutral torque where the torque of the core 20 is counterbalanced by the torque of the covering 30, as described above with reference to FIG. 2.

EXAMPLES

The invention will be further described in the following Examples.

Example 1

This example was performed on a laboratory spinning machine, spinntester SKF 82 equipped with PK 600 type arms designed for long staple processing also called worsted spinning.

The core yarn (20) was a black KEVLAR® para-aramid spun yarn with 100 dtex (Nm 100/1). This core yarn was spun from stretch-broken KEVLAR® fibers having a length of approximately 100 mm, spun in the Z direction with 800 turns/meter. The yarn was previously steamed.

The covering fiber (30) was NOMEX® meta-aramid fiber with a cut length of approximately 100 mm. This fiber was prepared into two slivers of 6666 dtex (Nm 1.5) each. A Siro-spinning spacer was used. The machine was set with a pre-draft setting of 1.5 and a main draft of 22 according a lamination of the roving slivers from 6666 dtex down to 6666/1.5/22=202 dtex.

The core yarn was positively fed at a speed of 16 m/min using a yarn-drive control system. For this, the core yarn was passed between a set of rolls driven at the given speed, and a heavy rubber-coated metallic roll.

The core yarn was deviated to the centering roller (55) and engaged in the fine guide groove (52) in the feed roller (50). This guide groove (52) was of approximately U-shaped cross-section, width 0.5 mm, depth 1 mm. The speed of the feed roller (50) was adjusted at 17.5 m/min.

Finally, the resulting composite core-spun yarn using NOMEX® meta-aramid fiber Ecru (natural color) in the covering was spun in the S-direction with a speed of 7500 turns per minute, achieving a resulting twist of 420 tpm for the covering fibers and a final count of (501 dtex) Nm 19.946. The final yarn was steamed.

Figure 7B:
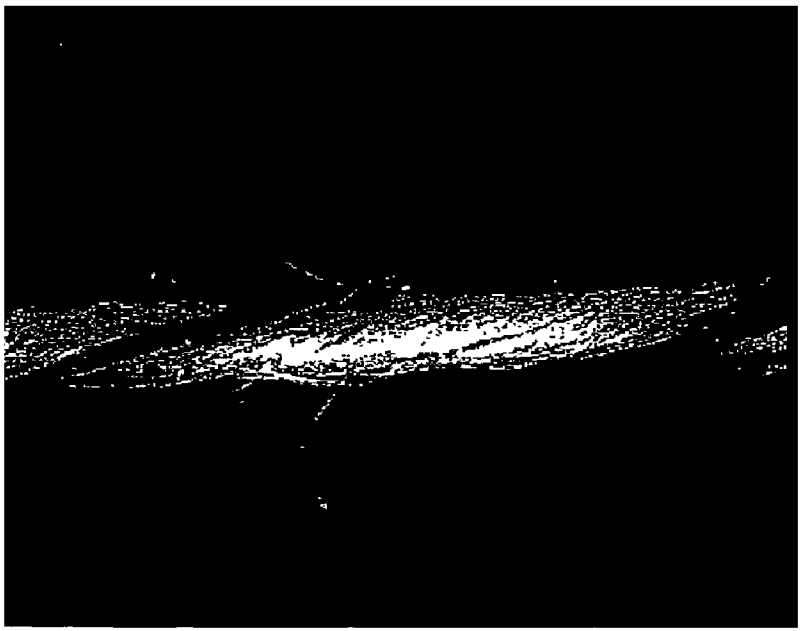
FIG. 7B is a corresponding photograph of a comparative yarn.
Figure 7A:
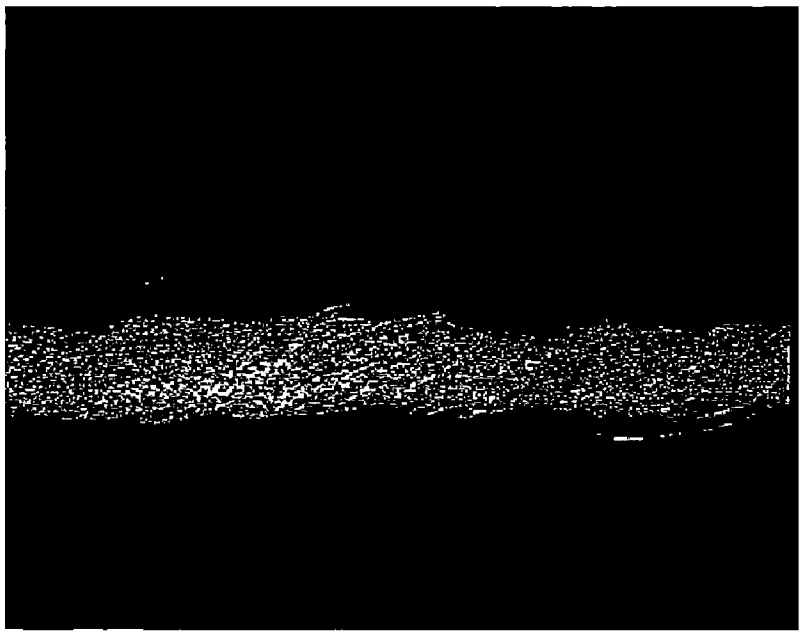
FIG. 7A is a photograph of an example of a composite core-spun yarn produced according to the invention.

FIG. 7A is a photograph of the resulting composite core-spun yarn (10) taken under a microscope using light from a Mercury short arc lamp. As can be seen the core is well covered, practically 100%. The resulting composite core-spun yarn is also substantially neutral, i.e., with virtually zero torque.

Table I summarizes the above-described conditions for Example 1, as well as the corresponding conditions for Example 2 (Comparative), Example 3 and Example 4 (Comparative).

TABLE I

| | Example 1 KEVLAR ® core (black) NOMEX ® covering (natural) With special roller system | Example 2 Comparative KEVLAR ® core (black) NOMEX ® covering (natural) Without special roller system | Example 3 KEVLAR ® core (yellow) NOMEX ® covering (natural) With special roller system | Example 4 Comparative KEVLAR ® core (yellow) NOMEX ® covering (natural) Without special roller system |
|---|---|---|---|---|
| Sliver Nm | Nm 2.3 | Nm 2.3 | Nm 2.3 | Nm 2.3 |
| Yarn final Nm | Nm 20 | Nm 20 | Nm 25 | Nm 25 |
| Twist tpm | 420 Tpm | 420 Tpm | 420 Tpm | 420 Tpm |
| Pre-draft value | 1.5 | 1.5 | 1.5 | 1.5 |
| Main-draft value | 22 | 22 | 28 | 28 |
| Speed of positive drive | 16 m/min | Without | 17.5 m/min | Without |
| Cylinder delivery speed | 17.5 m/min | 17.5 m/min | 17.5 m/min | 17.5 m/min |
| Spindle speed | 7500 Trs/m | 7500 Trs/m | 7500 Trs/m | 7500 Trs/m |

Example 2 (Comparative)

This Comparative Example duplicated the conditions of Example 1, except that the special grooved feed roller was replaced by a standard non-grooved feed roller and the core yarn was not fed at a controlled speed using positive drive, but was fed over the feed roller (cylinder) in the normal way.

FIG. 7B is a photograph like FIG. 7A of the resulting comparative yarn. It can be seen from FIG. 7B that the black "core" of the resulting yarn was spirally wound with the lighter-colored spirally wound "cover". The spiral black "core" is clearly visible. The resulting yarn, unlike that according to the invention, does not have a central core covered by the covering, but the two are wound together forming a composite twisted yarn. The core of this composite yarn is practically not covered. We can say that the covering is practically 0%.

Example 3

Example 3 repeats Example 1 except for the fact that the core was a yellow KEVLAR®. The main draft value was adjusted to 28. Also the yarn tension of the spun yarn was slightly increased by using a different ring traveler.

Figure 8B:
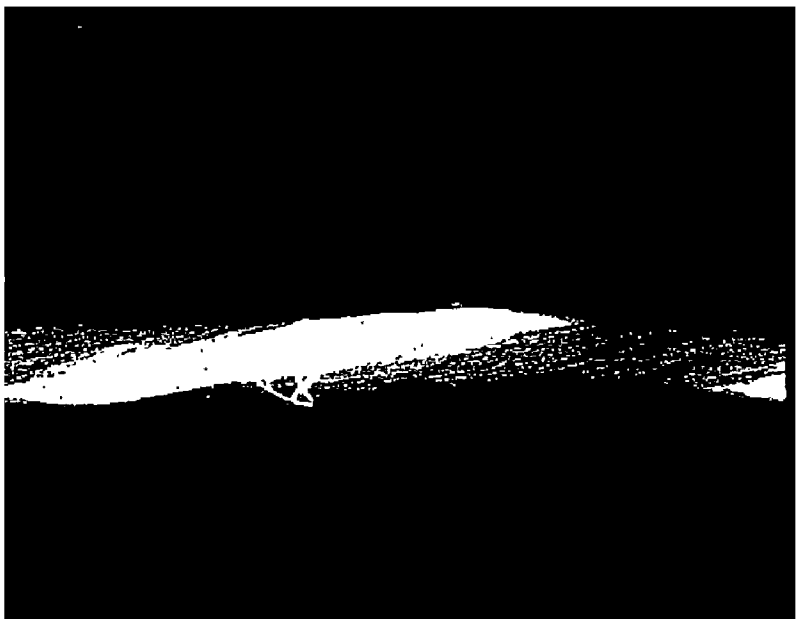
FIG. 8B is a corresponding photograph of another comparative yarn.
Figure 8A:
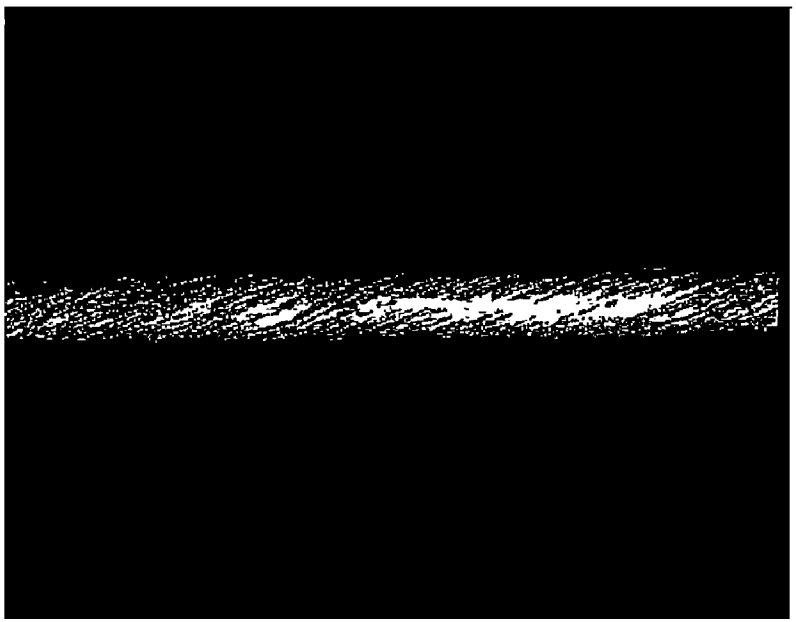
FIG. 8A is a photograph of another example of a composite core-spun yarn produced according to the invention.

FIG. 8A shows the resulting composite yarn, which is well covered, also practically 100%.

Example 4 (Comparative)

This Comparative Example duplicated the conditions of Example 3, except that the special grooved feed roller was replaced by a standard non-grooved feed roller and the core yarn was not fed at a controlled speed using positive drive, but was fed over the feed roller (cylinder) in the normal way.

FIG. 8B is a photograph like FIG. 8A of the resulting comparative yarn. It can be seen from FIG. 8B that the yellow "core" of the resulting yarn was spirally wound with the lighter-colored spirally wound "cover". The spiral yellow "core" is clearly visible. The resulting yarn, unlike that according to the invention, does not have a central core covered by the covering, but the two are wound together forming a composite twisted yarn. The core of this composite yarn is practically not covered. We can say that the covering is practically 0%. Moreover, the photographed section shows the yellow "core" bursting out from the twist-spun yarn.

Example 5

This Example was performed on a full-size commercial spinning machine specially adapted to operate according to this invention, to produce a high visibility composite yarn having a core (20) of poly (metaphenylene isophthalimide) (MPD-I) staple fiber and a covering (30) of crimped flame-retardant viscose (FRV) which is a regenerated cellulosic fiber incorporating a flame-retardant chlorine-free phosphorous and sulfur-containing pigment, available under the trademark "Lenzing FR".

The FRV fibers had a staple cut length of approximately 5 to 9 cm and an average measured staple length of 6.8 cm. The FRV fibers were separately stock died in a high visibility yellow color. These fibers were prepared according to the conventional long staple processing also called worsted spinning into two fine roving slivers of 6666 dtex (Nm 1.5) each. A Siro-spinning spacer was used. The machine was set with a pre-draft setting of 1.5 and a main draft of 22 according a lamination of the roving slivers from 6666 dtex down to 6666/1.5/25=177 dtex.

The core was spun from a crimped non-dyed (natural color) 100% poly (metaphenylene isophthalimide) (MPD-I) staple fiber, having a cut length in the range 8 to 12 cm and an average measured staple length of 10 cm. These staple fibers were then ring spun into staple yarns using conventional long staple worsted processing equipment.

The core yarn had a count of 10 tex and a twist of 800 tpm in the Z-direction. This staple core yarn was treated with steam to stabilize partly the yarn, and the steamed yarn was rewound on a special bobbin designed for cooperation with the devices on the spinning frame for fixing the core yarn bobbin. The core yarn tension was regulated using a yarn braking device, in addition to a positive feeding device. The core yarn was fed into the spinning system using a suitable centering roll (55) on top of the central guide groove (52) in the feed roll (50). The feed roll was working with 20 m/min. The core yarn speed was adjusted to a value v=18.3 m/min.

The covering (30) was spun in the S-direction with a speed of 9000 turns per minute applying a twist of 450 tpm in the S-direction.

The resulting composite yarn (10) had a cotton count of 20/1 or an approximate linear density of 450 denier (55 dtex). It was essentially neutral, i.e., torqueless.

The resulting composite yarns were woven at high speed in combination with Nm 40/2Meta-aramid into a 282 grams per square meter (8.3 ounces per square yard) special weave fabric. In the woven fabric, the composite twist-spun yarns of the invention were on top. The resulting composite yarn was also knitted into a Jersey fabric with 194 grams per square meter. Both knitted and woven fabric passed the test for high visibility using the EN 471 method, as well as the "limited flame spread" test as defined in the EN532.

This Example establishes that the method of the invention can be performed on a large scale under commercial high-speed spinning conditions leading to a perfectly satisfactory composite twist spun yarn of neutral torque in a one-step spinning process, and that the resulting composite twist spun yarn can be processed by large scale weaving processes to produce fabrics of desirable properties.

What is claimed is:

1. A process for producing a composite dual core-spun yarn with substantially no torque and having a central hard core covered with a dual-spun fiber covering, wherein the central hard core has an elongation of break less than 50% measured according to the methodology of ISO 2062, the process comprising:

(a) bringing together two fiber slivers to form a spinning triangle;

(b) feeding the central hard core in the spinning triangle between the two fiber slivers with the latter at an angle to the central core, the fed core being guided in the spinning triangle and having a Z or S twist that is overtwisted relative to the twist of the finished composite yarn;

(c) controlling the speed of feeding the core in the spinning triangle to compensate for the angle between the slivers and the core and for detwisting elongation of the core; and (d) spinning the brought-together fiber slivers around the core with an S or Z twist opposite to that of the core and corresponding to about 30% to about 70% of the twist of the fed overtwisted core to obtain a composite core-spun yarn with substantially no torque.

2. The process of claim 1, wherein the slivers are inclined at an angle θ to the fed core, the slivers are fed to the spinning triangle at a speed V, and the central hard core is fed to the spinning triangle at a speed close to k.V.cos θ, where k is a factor compensating for the detwisting elongation of the core.

3. The process of claim 1, wherein the core is chosen from the group consisting of monofilaments, multiple filaments, spun yarns and composites thereof.

4. The process of claim 1, wherein the core and the fiber covering are each independently made of materials chosen from the group consisting of glass, metal, synthetic fibers or filaments, carbon multifilaments or fibers, artificial fibers, natural fibers, antistatic fibers and composites thereof.

5. The process of claim 1, wherein the two inclined slivers are obtained by feeding from two parallel rovings.

6. The process of claim 1, wherein the core is driven at a controlled speed by a positive drive or by braking an overfed core.

7. The process of claim 1, wherein the two fiber slivers are brought together in the spinning triangle by passing over a feed roller having lateral smooth guide surfaces for the slivers, and the core is guided in the spinning triangle by passing through a guide groove centrally located on the feed roller.

8. The process of claim 1, wherein the core as fed has a twist coefficient α in the range 70-120 turns$\times g^{1/2}\times m^{-3/2}$, where $\alpha$=twist/(1000/tex)$^{-1/2}$ and tex=1000×mass(g)/length(m)

and wherein the hard core in the composite dual-spun yarn has a twist coefficient α in the range 35-60 turns$\times g^{1/2}\times m^{-3/2}$.

9. A device for producing a composite dual core-spun yarn with substantially no torque and having a central hard core covered with a dual-spun fiber covering, wherein the central hard core has an elongation of break less than 50% measured according to the methodology of ISO 2062, the core has an Z or S winding and the fiber covering has an S or Z winding opposite to that of the core, the device comprising:

(a) means for bringing together two fiber slivers in a spinning triangle;

(b) means for feeding said core in the spinning triangle between the two fiber slivers whereby the core is guided in the spinning triangle with the two fiber slivers at an angle to the core, the core having a Z or S winding that is overtwisted relative to the twist of the finished composite yarn;

(c) means for controlling the speed of feeding the core in the spinning triangle to compensate for the angle between the slivers and the core and for detwisting elongation of the core; and (d) means for spinning the brought-together fiber slivers around the core with an S or Z winding opposite to that of the core and corresponding to about 30% to about 70% of the twist of the fed overtwisted core to obtain said composite core-spun yarn with substantially no torque.

10. The device of claim 9, wherein the means for bringing together the two fiber slivers in a spinning triangle comprise a feed roller having lateral smooth guide surfaces for the slivers, and the means for feeding and for guiding the core in the spinning triangle comprise a guide groove centrally located on the feed roller.

11. The device of claim 10, wherein the guide groove is of substantially U-shaped cross section, the width and depth of the guide groove being sufficient to receive therein the core.

12. The device of claim 10, comprising a centering roller cooperating with the feed roller, the centering roller having a pre-guide groove positioned to guide the core centrally into the guide groove in the feed roller.

13. The device of claim 9, comprising means for positively driving the core at an adjusted speed, or for braking an overfed core to an adjusted speed.

* * * * *